US007104087B2

(12) United States Patent
Park et al.

(10) Patent No.: US 7,104,087 B2
(45) Date of Patent: Sep. 12, 2006

(54) MULTI-TYPE AIR CONDITIONER

(75) Inventors: Jong Han Park, Gwangmyeong-si (KR); Young Min Park, Incheon-si (KR)

(73) Assignee: LG Electronics Inc., Seoul (KR)

( * ) Notice: Subject to any disclaimer, the term of this patent is extended or adjusted under 35 U.S.C. 154(b) by 197 days.

(21) Appl. No.: 10/673,130

(22) Filed: Sep. 30, 2003

(65) Prior Publication Data

US 2004/0134224 A1 Jul. 15, 2004

(30) Foreign Application Priority Data

Jan. 13, 2003 (KR) ..... 10-2003-0002033

(51) Int. Cl.
*F25B 43/00* (2006.01)

(52) U.S. Cl. ..... 62/474; 62/83; 62/85; 62/498

(58) Field of Classification Search ..... 62/474, 62/498, 296, 292, 199, 83, 85, 64
See application file for complete search history.

(56) References Cited

U.S. PATENT DOCUMENTS

| | | | | |
|---|---|---|---|---|
| 3,065,610 A | | 11/1962 | Maudlin | |
| 4,177,145 A | | 12/1979 | Schumacher | |
| 4,180,988 A | | 1/1980 | Forte et al. | |
| 4,644,756 A | * | 2/1987 | Sugimoto et al. | 62/160 |
| 4,766,735 A | * | 8/1988 | Gotou | 62/175 |
| 5,237,833 A | * | 8/1993 | Hayashida et al. | 62/324.6 |
| 5,309,733 A | | 5/1994 | Hayashida et al. | |
| 5,379,606 A | * | 1/1995 | Katsuki et al. | 62/126 |
| 5,388,422 A | | 2/1995 | Hayashida et al. | |
| 6,276,158 B1 | | 8/2001 | Lowes et al. | |
| 6,519,958 B1 | * | 2/2003 | Moon et al. | 62/199 |
| 2002/0026800 A1 | | 3/2002 | Kassai et al | |
| 2003/0226370 A1 | | 12/2003 | Tanimoto et al. | |

FOREIGN PATENT DOCUMENTS

| | | |
|---|---|---|
| CN | 2357243 | 1/2000 |
| EP | 0496505 | 7/1992 |
| EP | 0974792 | 1/2000 |
| EP | 1054221 | 11/2000 |
| EP | 1334852 | 8/2003 |
| JP | 11-94395 | 4/1999 |
| JP | 11-230581 | 8/1999 |
| WO | 02/46663 | 6/2002 |

OTHER PUBLICATIONS

English Language Abstract of JP11–230581.
English Language Abstract of JP 11–94395.

* cited by examiner

*Primary Examiner*—Melvin Jones
(74) *Attorney, Agent, or Firm*—Greenblum & Bernstein, P.L.C.

(57) ABSTRACT

Multi-type air conditioner is disclosed for effective removal of foreign matters in refrigerant pipelines, including an outdoor unit having a compressor, an outdoor heat exchanger, a flow path control valve for controlling a flow path of the refrigerant from the compressor, and an outdoor unit piping system, a plurality of indoor units each having an indoor unit expansion device, an indoor heat exchanger, an indoor piping system, a distributor for receiving refrigerant from the outdoor unit, distributing the refrigerant to the indoor units proper to respective operation modes, and returning to the outdoor unit again, connection pipelines connected between the outdoor unit and the distributor, and foreign matter cutting off means mounted on each of the connection pipelines for prevention of the foreign matters from entering into the compressor of the outdoor unit.

20 Claims, 5 Drawing Sheets

MULTI-TYPE AIR CONDITIONER

This application claims the benefit of the Korean Application No. P2003-0002033 filed on Jan. 13, 2003, which is hereby incorporated by reference.

BACKGROUND OF THE INVENTION

1. Field of the Invention

The present invention relates to multi-type air conditioners, and more particularly, to a multi-type air conditioner having a device for effective removal of foreign matters present in a refrigerant pipeline.

2. Background of the Related Art

In general, the air conditioner is an appliance for cooling or heating spaces, such as living spaces, restaurants, and offices. At present, for effective cooling or heating of a space partitioned into many rooms, it is a trend that there has been ceaseless development of multi-type air conditioner. The multi-type air conditioner is in general provided with one outdoor unit and a plurality of indoor units each connected to the outdoor unit and installed in a room, for cooling or heating the room while operating in one of cooling or heating mode.

However, since the multi-type air conditioner is operative only in one mode of cooling or heating uniformly even if some of the many rooms within the partitioned space require heating, and rest of the rooms require cooling, the multi-type air conditioner has a limit in that the requirement can not be met, properly.

For an example, even in one building, there are rooms having a temperature difference depending on locations of the rooms or time of the day, such that while a north side room of the building requires heating, a south side room of the building requires cooling due to the sun light, which can not be dealt with a related art multi-type air conditioner that is operative in a single mode.

Moreover, even though a building equipped with a computer room requires cooling not only in summer, but also in winter for solving the problem of heat load of the computer related equipment, the related art multi-type air conditioner can not deal with such a requirement, properly.

In conclusion, the requirement demands development of multi-type air conditioner of concurrent cooling/heating type, for making air conditioning of rooms individually, i.e., the indoor unit installed in a room requiring heating is operable in a heating mode, and, at the same time, the indoor unit installed in a room requiring cooling is operable in a cooling mode.

In the meantime, the indoor units, the outdoor unit, and distributors in the air conditioner are in general connected with refrigerant pipeline of a metal. The units in the air conditioner and the refrigerant pipeline, and the refrigerant pipelines are connected by welding. However, there is slag in the refrigerant pipeline formed in the welding and left even after the welding is finished. Foreign matters left thus in the refrigerant pipeline after the welding is finished flows together with the refrigerant, resulting to damage components in the refrigerating system, or reduce a refrigerant flow passage. The reduced flow passage impedes a smooth refrigerant flow, and results in poor cooling or heating of the air conditioner.

SUMMARY OF THE INVENTION

Accordingly, the present invention is directed to a multi-type air conditioner that substantially obviates one or more of the problems due to limitations and disadvantages of the related art.

An object of the present invention is to provide a multi-type air conditioner, which can heat or cool rooms individually proper to room requirements at the same time, and having a device for preventing foreign matters from entering into units in the air conditioner, such as an outdoor unit, indoor units, and the like.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the multi-type air conditioner includes an outdoor unit having a compressor, an outdoor heat exchanger, a flow path control valve for controlling a flow path of the refrigerant from the compressor, and an outdoor unit piping system, a plurality of indoor units each having an indoor unit expansion device, an indoor heat exchanger, an indoor piping system, a distributor for receiving refrigerant from the outdoor unit, distributing the refrigerant to the indoor units proper to respective operation modes, and returning to the outdoor unit again, connection pipelines connected between the outdoor unit and the distributor, and foreign matter cutting off means mounted on each of the connection pipelines for prevention of the foreign matters from entering into the compressor of the outdoor unit.

The foreign matter cutting off means is mounted adjacent to ports of the outdoor unit connected to the connection pipelines. The foreign matter cutting off means may be further mounted adjacent to ports of the indoor units having the connection pipelines connected thereto. The foreign matter cutting off means may be for, an example, a strainer.

The operation mode includes a first operation mode for cooling all rooms, a second operation mode for heating all rooms, a third operation mode for cooling a major number of rooms and heating a minor number of rooms, and a fourth operation mode for heating a major number of rooms and cooling a minor number of rooms.

The flow path control valve includes a first port in communication with an outlet of the compressor, a second port in communication with the outdoor heat exchanger, a third port in communication with an inlet of the compressor, and a fourth port blanked or connected to a blanked pipe piece.

The outdoor unit piping system includes a first pipeline connected between the outlet of the compressor and the first port, a second pipeline connected between the second port and the first port of the outdoor unit having the outdoor heat exchanger mounted thereon, a third pipeline connected between the first pipeline and the second pipeline of the outdoor unit, and a fourth pipeline connected between the third port and the inlet of the compressor having an intermediate point connected to the third port of the outdoor unit.

The outdoor unit further includes an accumulator mounted on the fourth pipeline between the third port of the outdoor unit and the inlet of the compressor. The outdoor unit further includes a check valve mounted on the second pipeline between the outdoor heat exchanger and the first port of the outdoor unit, and an outdoor unit electronic expansion device mounted on the second pipeline in parallel with the check valve. The check valve permits refrigerant flow from the outdoor heat exchanger toward the first port, only.

The connection pipelines include a first connection pipeline connected between the first port of the outdoor unit and the first port of the distributor, a second connection pipeline connected between the second port of the outdoor unit and the second port of the distributor, and a third connection pipeline connected between the third port of the outdoor unit and the third port of the distributor.

The distributor includes a distributor piping system for guiding refrigerant flow from the outdoor unit to the indoor units, and vice versa, and a valve bank mounted on the distributor piping system for controlling the refrigerant flow in the distributor piping system proper to respective operation modes. The distributor piping system includes a liquid refrigerant pipeline having a first port of the distributor, a plurality of liquid refrigerant branch pipelines branched from the liquid refrigerant pipeline and connected to the indoor unit expansion devices in the indoor units respectively, a gas refrigerant pipeline having a second port of the distributor, a plurality of first gas refrigerant branch pipelines branched from the gas refrigerant pipeline and connected to the indoor heat exchangers of the indoor units respectively, a plurality of second gas refrigerant branch pipelines branched from intermediate points of the first gas refrigerant branch pipelines respectively, a return pipeline having all the second gas refrigerant pipelines connected thereto, and a third port of the distributor. The valve bank includes a plurality of open/close valves mounted on the first and second gas refrigerant branch pipelines.

The distributor further includes means for preventing liquefaction of refrigerant discharged from the compressor and filled in the third pipeline fully. The means includes, a bypass pipeline connected between the return pipeline and the gas refrigerant pipeline, and a distributor expansion device on the bypass pipeline.

In another aspect of the present invention, there is provided a multi-type air conditioner including an outdoor unit having a compressor, an outdoor heat exchanger, and an outdoor unit piping system, a plurality of indoor units each having an expansion device, an indoor heat exchanger, an indoor piping system, connection pipelines connected between the outdoor unit and the indoor units, and foreign matter cutting off means mounted on each of the connection pipelines for prevention of the foreign matters from entering into the compressor of the outdoor unit.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments of the present invention, same parts will be given the same names and reference symbols, and repetitive description of which will be omitted.

Figure 1:
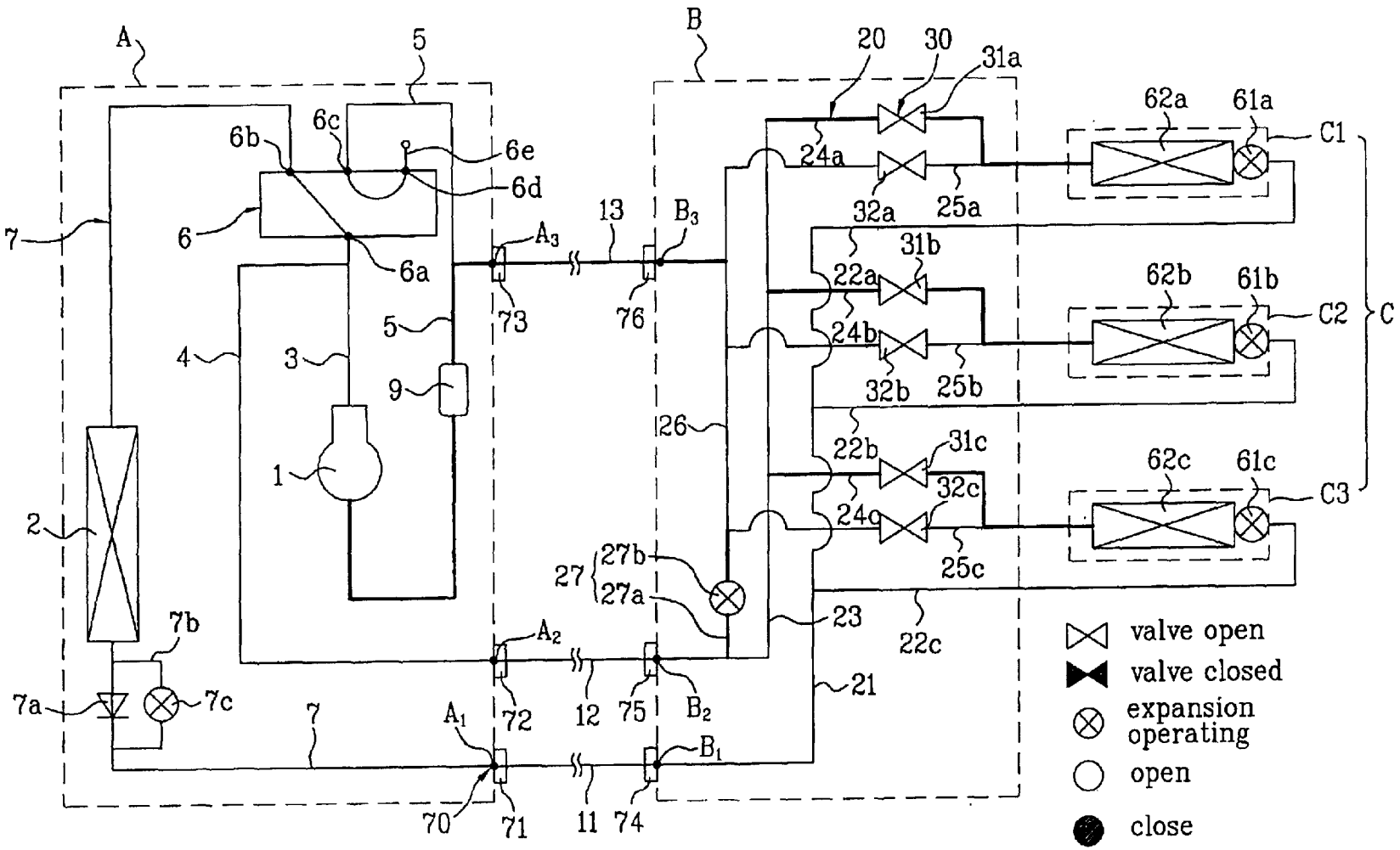
FIG. 1 illustrates a system of a multi-type air conditioner in accordance with a preferred embodiment of the present invention.

Referring to FIG. 1, the air conditioner includes an outdoor unit 'A', a distributor 'B', and a plurality of indoor units 'C'; 'C1', 'C2', and 'C3'. The outdoor unit 'A' has a compressor 1, an outdoor heat exchanger 2, a flow path control valve 6, and an outdoor unit piping system, and the distributor 'B' has a distribution piping system 20, and a valve bank 30. Each of the indoor units 'C'; has an indoor heat exchanger 62 and indoor unit expansion device 61.

The air conditioner has a system in which rooms the indoor units 'C'; 'C1', 'C2', and 'C3' are installed therein respectively are cooled or heated individually according to different operation modes of a first operation mode of cooling all rooms, a second operation mode of heating all rooms, a third operation mode of cooling a major number of the rooms and heating a minor number of rooms, and a fourth operation mode of heating a major number of the rooms and cooling a minor number of rooms, detail of one preferred embodiment of which will be described with reference to FIG. 1.

For convenience of description, the following drawing reference symbols, 22 represents 22*a*, 22*b*, and 22*c*, 24 represents 24*a*, 24*b*, and 24*c*, 25 represents 25*a*, 25*b*, and 25*c*, 31 represents 31*a*, 31*b*, and 31*c*, 32 represents 32*a*, 32*b*, and 32*c*, 61 represents 61*a*, 61*b*, and 61*c*, 62 represents 62*a*, 62*b*, and 62*c*, and C represents C1, C2, and C3. Of course, a number of the indoor units 'C' and numbers of elements related thereto are varied with a number of rooms, and for convenience of description, the specification describes assuming a case when there are three rooms, i.e., a number of the indoor units are three.

The outdoor unit 'A' of the air conditioner of the present invention will be described. Referring to FIG. 1, there is a first pipeline 3 connected to an outlet of the compressor 1. The first pipeline 3 is connected to the flow path control valve 4, which controls a flow path of gas refrigerant from the compressor 1 according to respective operation modes. The flow path control valve has four ports, of which first port 6*a* is connected to the first pipeline 3.

The second port 6*b* of the flow path control valve 4 is connected to a second pipeline 7. The second pipeline 7 has one end connected to the second port 6*b* of the flow path control valve 6, and the other end connected to a first port A1 of the outdoor unit 'A' as shown in FIG. 1. As shown in FIG. 1, there is the outdoor heat exchanger 2 in the middle of the second pipeline 7.

The third port 6*c* of the flow path control valve 6 is connected to a fourth pipeline 5. The fourth pipeline 5 has one end connected to the third port 6*c*, and the other end connected to an inlet of the compressor 1. An intermediate point of the fourth pipeline 5 is in communication with the third port A3 of the outdoor unit 'A'. In the meantime, an intermediate point of the fourth pipeline 5, in more detail, at a point between the inlet of the compressor 1 and the third port A3 of the outdoor unit 'A', there is an accumulator 9.

As shown in FIG. 1, the fourth port 6*d* of the flow path control valve 6 is connected to a pipe piece 6*e* with one blanked end. Or, the fourth port 6*d* may not be connected to the pipe piece, but the fourth port 6*d* itself may be closed.

The flow path control valve 6 makes the first port 6*a* and the second port 6*b* in communication and, at the same time with this, makes the third port 6*c* and the fourth port 6*d* in communication when the multi-type air conditioner is in operation in the first or third operation mode. Also, the flow path control valve 6 makes the first port 6*a* and the fourth port 6*d* in communication and, at the same time with this, makes the second port 6*b* and the third port 6*c* in communication when the multi-type air conditioner is in operation in the second or fourth operation mode. The refrigerant flow controlled thus by the flow path control valve 6 will be described in detail, later.

In the meantime, there is a third pipeline 4, one end of which is connected to the middle of the first pipeline 3. The other end of the third pipeline 4 is connected to a second port A2 of the outdoor unit 'A'. There is a check valve 7*a* on an intermediate point of the second pipeline 7, in more detail, a point between the outdoor heat exchanger 2 and the first port A1 of the outdoor unit 'A'. It is preferable that the check valve 7*a* is mounted adjacent to the outdoor heat exchanger 2. There is an outdoor unit expansion device 7*c* on the second pipeline 7 in parallel to the check valve 7*a*. For this, a parallel pipe piece 7*b* having two ends connected to an inlet and an outlet of the check valve 7*a* is provided, and the outdoor expansion device 7*c* is mounted on the parallel pipe piece 7*b*.

The check valve 7*a* passes refrigerant flowing from the outdoor heat exchanger 2 to the first port A1 of the outdoor unit 'A', and blocks refrigerant flowing from the first port A1 of the outdoor unit 'A' to the outdoor heat exchanger 2. Therefore, the refrigerant flowing from the first port A1 of the outdoor unit 'A' to the outdoor heat exchanger 2 bypasses the check valve 7*a* to pass through the parallel pipe 7*b* and the outdoor unit expansion device 7*c*, and therefrom flows into the outdoor heat exchanger 2.

The outdoor unit 'A' having the foregoing system is connected to the distributor 'B' with a plurality of connection pipelines. For this, of the connection pipelines, a first connection pipeline 11 connects the first port A1 of the outdoor unit 'A' to the first port B1 of the distributor 'B', and a second connection pipeline 12 connects a second port A2 of the outdoor unit 'A' and a second port B2 of the distributor 'B', and a third connection pipeline 13 connects a third port A3 of the outdoor unit 'A' and a third port B3 of the distributor 'B'. Accordingly, in the multi-type air conditioner of the present invention, the outdoor unit 'A' and the distributor 'B' are connected with three pipelines.

In the meantime, it is required that the distributor 'B' guides the refrigerant from the outdoor unit 'A' to selected indoor unit 'C' exactly. Moreover, it is required that the plurality of pipelines connecting the distributor 'B' to the plurality of indoor unit 'C' are simplified, for easy piping work and improving an outer appearance. As shown in FIG. 1, the distributor 'B' of the air conditioner of the present invention designed taken the foregoing matters into account includes the distributor piping system 20, and the valve bank 30.

The distributor piping system 20 guides refrigerant flow from the outdoor unit 'A' to the indoor units 'C', and vice versa. The distributor piping system 20 includes a liquid refrigerant pipeline 21, a plurality of liquid refrigerant branch pipelines 22, a gas refrigerant pipeline 23, and a plurality of first refrigerant branch pipelines 24, a plurality of second branch pipelines 25, and a return pipeline 26.

Referring to FIG. 1, the liquid refrigerant pipeline 21 provides a first port B1 of the distributor 'B' for connection to the first connection pipeline 11. The plurality of liquid refrigerant branch pipelines 22 are branched from the liquid refrigerant pipeline 21 and connected to the indoor unit expansion devices 61 in the indoor units 'C', respectively. The gas refrigerant pipeline 23 provides a second port B2 of the distributor 'B' for connection to the second connection pipeline 12. The plurality of first gas refrigerant branch pipelines 24 are branched from the gas refrigerant pipeline 23 and connected to the indoor heat exchangers 62 of the indoor units C, respectively. The plurality of second gas refrigerant branch pipelines 25 are branched from intermediate points of the first gas refrigerant branch pipelines 24 respectively. As shown in FIG. 1, the return pipeline 26 has all the second gas refrigerant pipelines 25 connected thereto. The return pipe 26 has a third port B3 of the distributor 'B'.

The valve bank 30 in the distributor 'B' controls refrigerant flow in the distributor piping system, such that gas or liquid refrigerant is introduced into the indoor units in the rooms selectively, and returns from the indoor units 'C' to the outdoor unit 'A'. As shown in FIG. 1, the valve bank 30 includes a plurality of open/close valves 31*a*, 31*b*, 31*c*, 32*a*, 32*b*, and 32*c* mounted on the first gas refrigerant branch pipelines 24 and the second gas refrigerant branch pipelines 25, respectively. The valves 31 and 32 open or close the first gas refrigerant branch pipelines 24 and the second gas refrigerant branch pipelines 25 respectively for controlling refrigerant flow paths according to the operation modes. In the meantime, detailed control of the valve bank 30 will be described in a description of operation of the air conditioner of the present invention for each operation mode.

The distributor 'B' of the multi-type air conditioner of the present invention may also include means 27 for preventing high pressure refrigerant staying in the second connection pipeline 12 from being liquefied when the multi-type air conditioner is in the first operation mode. Because there may be shortage of refrigerant for cooling or heating if the high pressure refrigerant is stagnant and liquefied in the second connection pipeline 12, the means 27 is provided to the distributor 'B' for vaporizing liquid refrigerant and preventing liquefaction of the high pressure refrigerant in the second connection pipeline 12 to prevent shortage of refrigerant in the air conditioner at the end. The means 27 includes a bypass pipe 27*a* connected between the return pipeline 26 and the gas refrigerant pipeline 23, and a distributor expansion device 27 on the bypass pipeline 27*a*. The operation of the means 27 will be described in detail, later.

In the meantime, the indoor unit 'C', installed in each room, includes the indoor heat exchanger 62, indoor unit expansion device 61, and room fan (not shown). The indoor heat exchanger 62 is connected to respective first gas refrigerant branch pipeline 24 in the distributor 'B', and the indoor unit expansion device 61 is connected to respective liquid refrigerant branch pipeline 22 in the distributor 'B'. The indoor heat exchangers 62 and the indoor unit expansion devices 61 are connected with refrigerant pipe. The room fan blows air to respective indoor heat exchanger 62.

Foreign matter cutting off means provided to the multi-type air conditioner of the present invention will be described. Before starting, necessity of the foreign matter cutting off means will be described, briefly. In general, the outdoor unit 'A' is installed outdoor, particularly, on a roof top of a building, and the distributor 'B' is installed indoor.

Therefore, the distributor 'B' and the outdoor unit 'A' are installed far from each other, to require long first to third connection pipelines 11, 12, and 13 between the distributor 'B' and the outdoor unit 'A'. It is difficult that the first to third connection pipelines 11, 12, and 13 are fabricated with one piece of pipe. It is liable that foreign matters may enter into the pipeline when a plurality of pieces of pipe are welded. Moreover, slag is formed in the pipe during welding. The foreign matters, including the slag in the welding may be entrained on the refrigerant, and enter into the compressor 1 in the outdoor unit 'A'. If the foreign matters enter into the compressor 1, a lifetime of the compressor 1 is reduced, and an air conditioning efficiency becomes poor as a compression efficiency drops.

The present invention provides foreign matter removing means 70 for preventing the foreign matters in the first to third connection pipelines, which cause such problems, from entering into the compressor 1 in the outdoor unit 'A'. The foreign matter removing means 70 is mounted on the first to third connection pipelines 11, 12, and 13, separately. As shown in FIG. 1, it is preferable that the foreign matter removing means 70 is mounted adjacent to the first to third ports A1, A2, and A3.

In the meantime, the foreign matters in the first to third connection pipelines 11, 12, and 13 may enter into the distributor 'B' and the indoor units 'C', as well as the valves, the expansion devices, and the indoor heat exchangers 62, and cause malfunction and out of order of the units. Therefore, as shown in FIG. 1, it is preferable that the foreign matter removing means 70 is also mounted adjacent to the first to third ports B1, B2, and B3 of the distributor 'B'.

The foreign matter removing means 70 may be embodied in a variety of forms. That is, the foreign matter removing means 70 may be strainers, or electric magnets (not shown) for cutting off flow of the foreign matters by using filter (not shown), or means for cutting off flow of the foreign matters by using a chemical reaction. In view of simplification of the device and cost, employment of a strainer as the foreign matter removing means 70, which may thus be embodied in a variety of forms, is the most favorable. Therefore, the foreign matter removing means 70 mounted adjacent to the first to third ports A1, A2, and A3 of the outdoor unit 'A' will be respectively called as first to third strainers 71, 72, and 73, and the foreign matter removing means 70 mounted adjacent to the first to third ports B1, B2, and B3 of the distributor 'B' will be called as fourth to sixth strainers 74, 75, and 76.

In the multi-type air conditioner of the present invention, a flow path and a flow direction of the gas refrigerant from the compressor 1 are changed under the control of the flow path control valve 6 in the outdoor unit 'A', and a flow path and a flow direction of the gas refrigerant are changed under the control of the valve bank 30 in the distributor 'B' and the indoor unit 'C', in individual heating or cooling of the rooms. Refrigerant flow under the control of the flow path control valve 6 and the valve bank 30 in the individual cooling or heating of the rooms will be described for each of the operation modes, hereafter. For convenience of description, it is assumed that two indoor units C1 and C2 cool the rooms, and the other one indoor unit C3 heat the room in the third operation mode. It is also assumed that two indoor units C1 and C2 heat the rooms and the other one indoor unit C3 cools the room in the fourth operation mode.

Figure 2A:
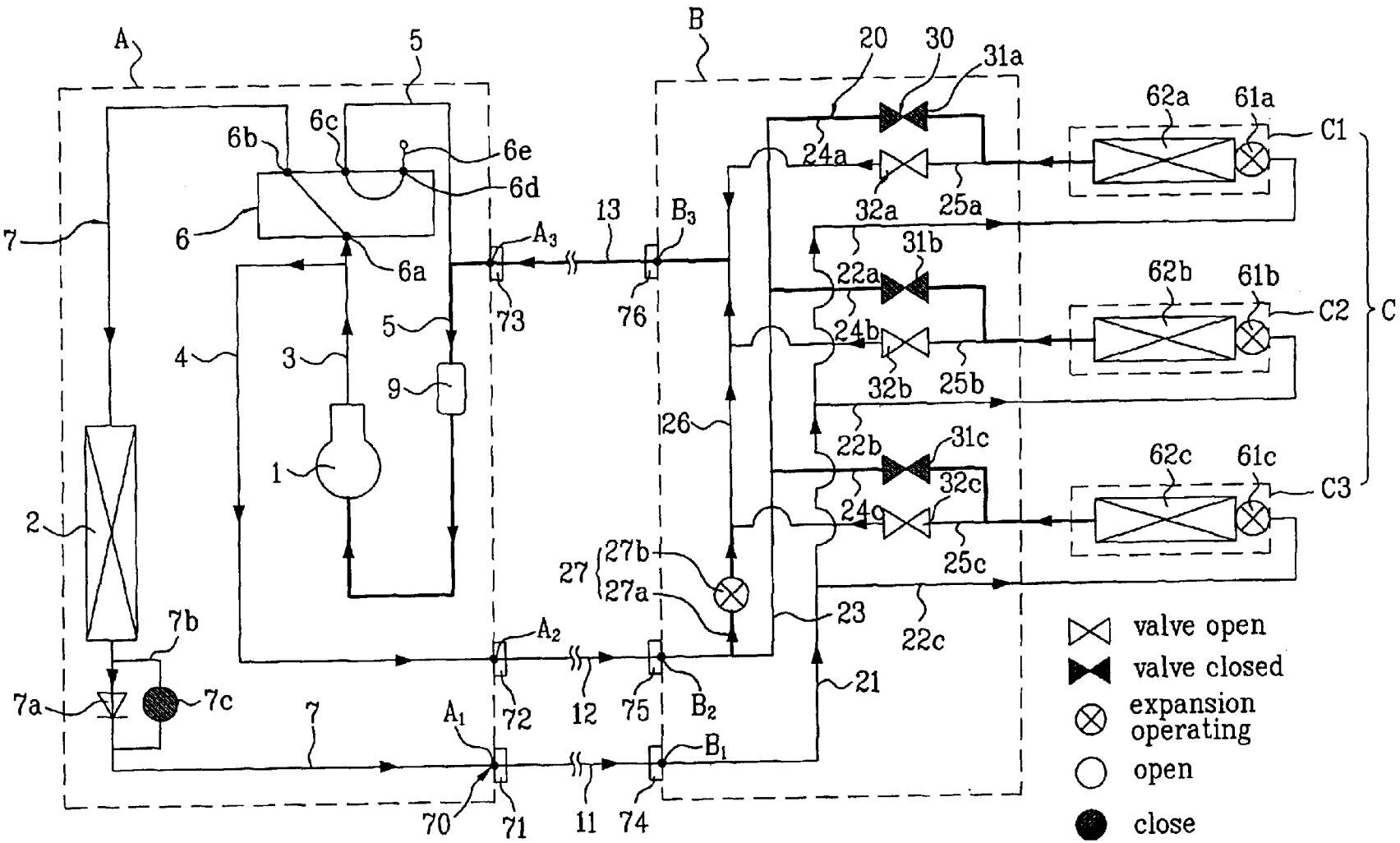
FIG. 2A illustrates a system showing operation of the system in FIG. 1 in cooling all rooms.

FIG. 2A illustrates a system showing operation of the system in FIG. 1 in cooling all rooms. In the first operation mode when all the indoor units cool the rooms, the flow path control valve 6 makes the first port 6*a* and the second port 6*b* in communication, and at the same time makes the third port 6*c* and the fourth port 6*d* in communication. Accordingly, most of the refrigerant from the outlet of the compressor 1 is introduced into the second pipeline 7 via the first pipeline 3. As shown in FIG. 2A, a portion of the refrigerant from the compressor 1 is introduced into the third pipeline 4 connected to the first pipeline 3. A refrigerant flow introduced into the second pipeline 7 from the compressor 1 will be described.

The refrigerant introduced into the second pipeline 7 heat exchanges with the external air, and condensed at the outdoor heat exchanger 2. The condensed liquid refrigerant is introduced into the liquid refrigerant pipeline 21 in the distributor 'B' via the check valve 7*a*, the first port A1 of the outdoor unit 'A', and the first connection pipeline 11. In this instance, the fourth strainer 74 mounted adjacent to the first port B1 of the distributor 'B' cuts off entrance of the foreign matters from the first connection pipeline 11 into the distributor 'B', effectively. The refrigerant is introduced from the liquid refrigerant pipeline 21 in the distributor 'B' to the indoor unit expansion devices 61 through the liquid refrigerant branch pipelines 22, respectively. The refrigerant expanded at the indoor unit expansion devices 61 heat exchanges at the indoor heat exchangers 62 to cool the rooms, respectively.

In the first operation mode, the valve bank 30 in the distributor 'B' is controlled such that the valves 31*a*, 31*b* and 31*c* on the first gas refrigerant pipelines 24*a*, 24*b* and 24*c* are closed, and the valves 32*a*, 32*b*, and 32*c* on the second gas refrigerant pipelines 25*a*, 25*b*, and 25*c* are opened. Therefore, as shown in FIG. 2A, the gas refrigerant vaporized at the indoor heat exchangers 62 while cooling down the room air is introduced into the return pipeline 26 through the second gas refrigerant branch pipelines 25.

In the meantime, the refrigerant, discharged from the compressor 1 to the third pipeline 4, is introduced into the gas refrigerant pipeline 23 via the second port A2 of the outdoor unit 'A', the second connection pipeline 12, and the second port B2 of the distributor 'B'. In this instance, the fifth strainer 75 mounted adjacent to the second port B2 of the distributor 'B' prevents entrance of the foreign matters from the second connection pipeline 12 into the distributor 'B'. In the meantime, as shown in FIG. 2A, since the valves 31*a*, 31*b*, and 31*c* mounted on the first gas refrigerant branch pipelines 24 connected to the gas refrigerant pipeline 23 are closed, the gas refrigerant introduced into the gas refrigerant pipeline 23 is guided to the bypass pipeline 27*a*, and, therefrom, flows to the return pipeline 26 after expanded at the distributor expansion device 27*b*. Accordingly, the means 27 prevents liquefaction of the gas refrigerant filled fully in the third pipeline 4 and the second connection pipeline 12 in a stagnant state, effectively.

The gas refrigerant joined at the return pipeline 26 is introduced into the fourth pipeline 5 via the third port B3 of the distributor 'B', the third connection pipeline 13, and the third port A3 of the outdoor unit 'A'. In this instance, the third strainer 73 mounted adjacent to the third port A3 of the outdoor unit 'A' prevents the foreign matters in the third connection pipeline 13 from entering into the outdoor unit 'A', effectively. In the meantime, the third port 6*c* of the flow path control valve 6 one end of the fourth pipeline 5 is connected thereto is in communication with the fourth port 6*d* connected to the blanked pipe piece 6*e* in the first operation mode. Therefore, the refrigerant is introduced from the fourth pipeline 5 to the inlet of the compressor 1 via the accumulator 9.

Figure 2B:
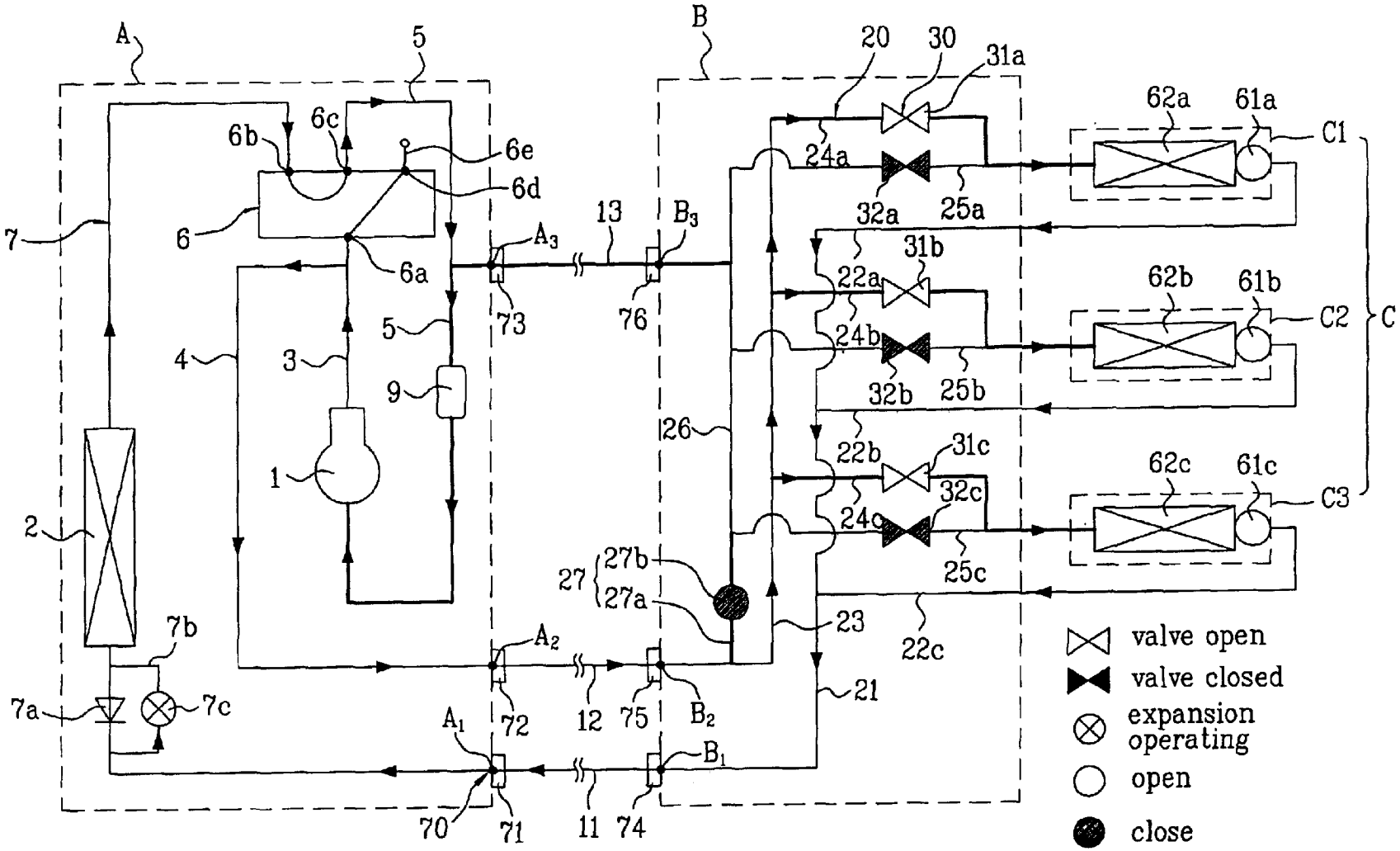
FIG. 2B illustrates a system showing operation of the system in FIG. 1 in heating all rooms.

FIG. 2B illustrates a system showing operation of the system in FIG. 1 in the second operation mode. In the second operation mode, when all rooms are heated, the flow path control valve 6 makes the first port 6*a* and the fourth port 6*d* in communication, and at the same time makes the second port 6*b* and the third port 6*c* in communication. According to this, as shown in FIG. 2B, entire refrigerant is introduced from the compressor 1 to the third pipeline 4 via the first pipeline 3. The gas refrigerant is introduced from the third pipeline 4 into the gas refrigerant pipeline 23 via the second port A2 of the outdoor unit 'A', the second connection pipeline 12, and the second port of the distributor 'B'. In this instance, the fifth strainer 75 mounted adjacent to the second port B2 of the distributor 'B' prevents the foreign matters in the second connection tube 12 from entering into the distributor 'B', effectively.

In the second operation mode, the distributor expansion device 27*b* is closed, the valves 31*a*, 31*b*, and 31*c* on the first gas refrigerant branch pipelines 24 are opened, and the valve 32*a*, 32*b*, and 32*c* on the second gas refrigerant branch pipelines 25 are closed. Therefore, entire refrigerant introduced into the gas refrigerant pipeline 23 is introduced into the first gas refrigerant branch pipelines 24, and heat exchanges with room air, and is condensed at the indoor heat exchangers 62. In this instance, the indoor heat exchanger 62 discharges condensing heat, and the room fan (not shown) discharges the condensing heat into the room, to heat the room. As shown in FIG. 2B, since the indoor unit expansion device 61 is opened in the second operation mode, the refrigerant condensed at the indoor heat exchanger 62 is introduced into the liquid refrigerant pipeline 21 through the liquid refrigerant branch pipelines 22.

Then, the refrigerant is introduced from the liquid refrigerant pipeline 21 into the second pipeline 7 via the first port B1 of the distributor B, the first connection pipeline 11, and the first port A1 of the outdoor unit 'A'. In this instance, the first strainer 71 mounted adjacent to the first port A1 of the outdoor unit 'A' cuts off the foreign matters in the first connection pipeline 11 entering into the outdoor unit, effectively. The refrigerant is introduced from the second pipeline 7 to the parallel pipe piece 7*b* under the guidance of the check valve 7*a*, and expanded at the outdoor expansion valve 7*c*. The expanded refrigerant heat exchanges, and is vaporized at the outdoor heat exchanger 2. Then, the vaporized refrigerant is introduced into the fourth pipeline 5 guided by the flow path control valve 6, and enters into the inlet of the compressor 1 via the accumulator 9. In this instance, since the valves 32*a*, 32*b*, and 32*c* mounted on the second gas refrigerant branch pipelines 25 are closed, the refrigerant is only introduced from the fourth pipeline 5 to the compressor 1. Of course, though a portion of the refrigerant may be introduced up to the return pipeline 26 through the third connection pipeline 13, the amount is very small. In this case, the strainer 76 prevents the foreign matters in the third connection pipeline 13 from entering into the distributor 'B'.

Figure 3A:
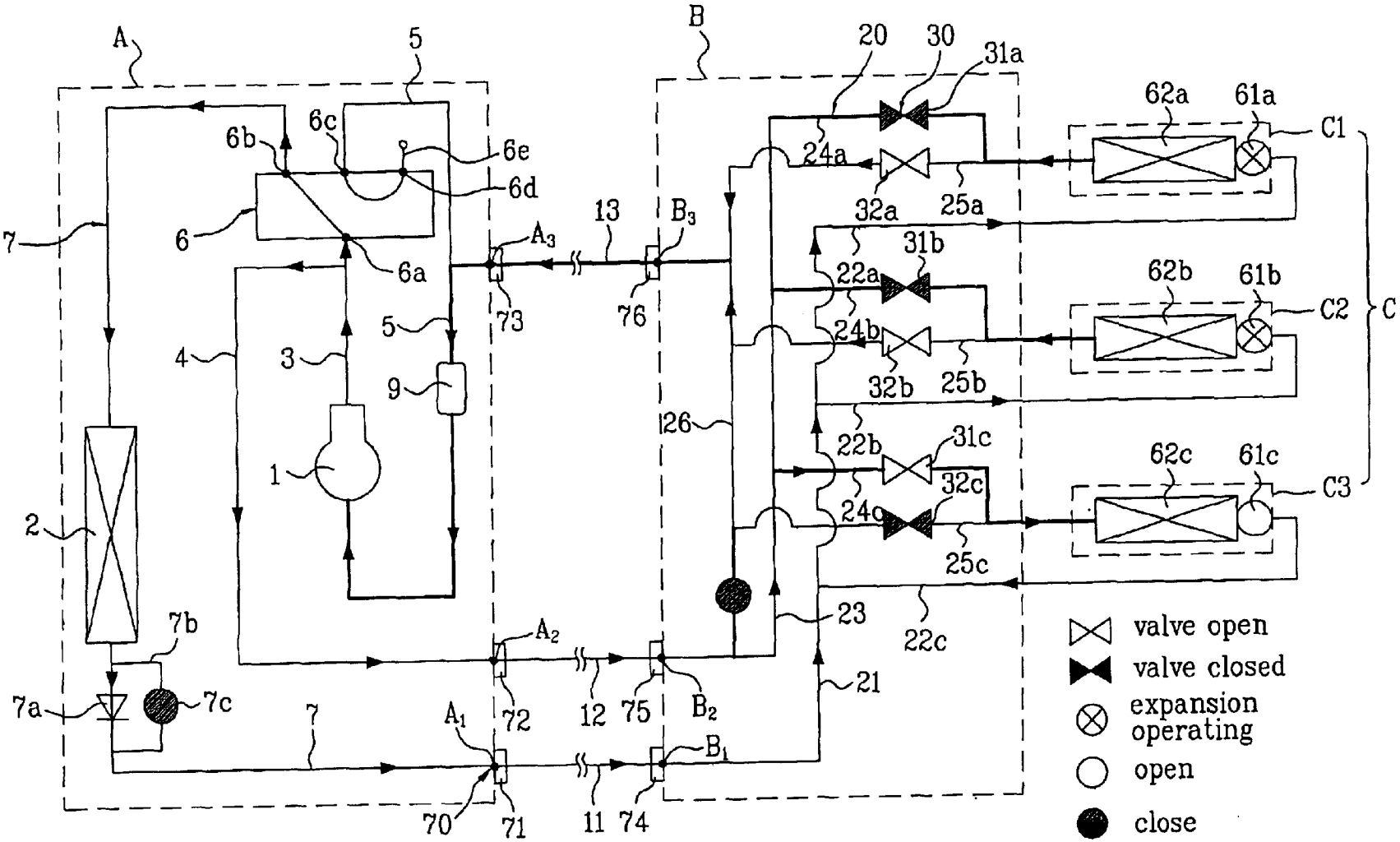
FIG. 3A illustrates a system showing operation of the system in FIG. 1 in cooling a major number of rooms and heating a minor number of rooms.

FIG. 3A illustrates a system showing operation of the system in FIG. 1 in the third operation mode. Identical to the first operation mode, in the third operation mode, when a major number of rooms are cooled, and a minor number of rooms are heated, the flow path control valve makes the first port 6*a* and the second port 6*b* in communication, and the third port 6*c* and the fourth port 6*d* in communication. Therefore, a portion of the refrigerant is introduced from the compressor 1 into he second pipeline 7, and the other portion is introduced into the third pipeline 4. Description of the process, identical to the refrigerant flow in the first operation mode described with reference to FIG. 2A, will be omitted. However, an attention is invited to the fact the fourth and fifth strainers 74 and 75 prevent the foreign matters from entering into the distributor 'B' when the refrigerant is introduced into the distributor 'B' through the first and second connection pipelines 11 and 12, once more.

In the third operation mode, the distributor expansion device 27*b* is closed. The valves 31*a* and 31*b*, mounted on the first gas refrigerant branch pipelines 24*a* and 24*b* connected to the indoor units C1 and C2 which cool the rooms, are closed, and the valves 32*a* and 32*b* mounted on the second gas refrigerant branch pipelines 25*a* and 25*b* are opened. The valve 31*c* on the first gas refrigerant branch pipeline 24*c* connected to the indoor unit C3 which heats the room is opened, and the valve 32*c* on the second gas refrigerant branch pipeline 25*c* is closed. Therefore, as shown in FIG. 3A, the refrigerant, passed through the third pipeline 4 and introduced into he gas refrigerant pipeline 23 of the distributor 'B', is introduced into the indoor heat exchanger 62*c* in the indoor unit C3 via the first gas refrigerant branch pipeline 24*c*, discharges condensing heat at the indoor heat exchanger 62*c* to heat the room, and introduced into the liquid refrigerant pipeline 21 via the indoor unit expansion device 61*c* in a liquid state.

Referring to FIG. 3A, the refrigerant, discharged from the compressor 1 to the liquid refrigerant pipeline 21 in the distributor 'B' via the second pipeline 7, joins with the refrigerant introduced into the liquid refrigerant pipeline 21 after heating the room at the indoor unit C3. Then, the joined refrigerant is introduced into the indoor unit expansion devices 61*a* and 61*b* of the indoor units C1 and C2 through the liquid refrigerant branch pipelines 22*a* and 22*b*, vaporized at the indoor heat exchangers 62*a* and 62*b*, to cool the rooms, and introduced into the return pipeline 26 via the second gas refrigerant branch pipeline 25*a* and 25*b*. The refrigerant is introduced from the return pipeline 26 to the fourth pipeline 5 through the third connection pipeline 13, and, therefrom, to the inlet of the compressor 1 via the accumulator 9. In this instance, the third strainer 73 prevents the foreign matters in the third connection pipeline 13 from entering into the outdoor unit 'A'.

Figure 3B:
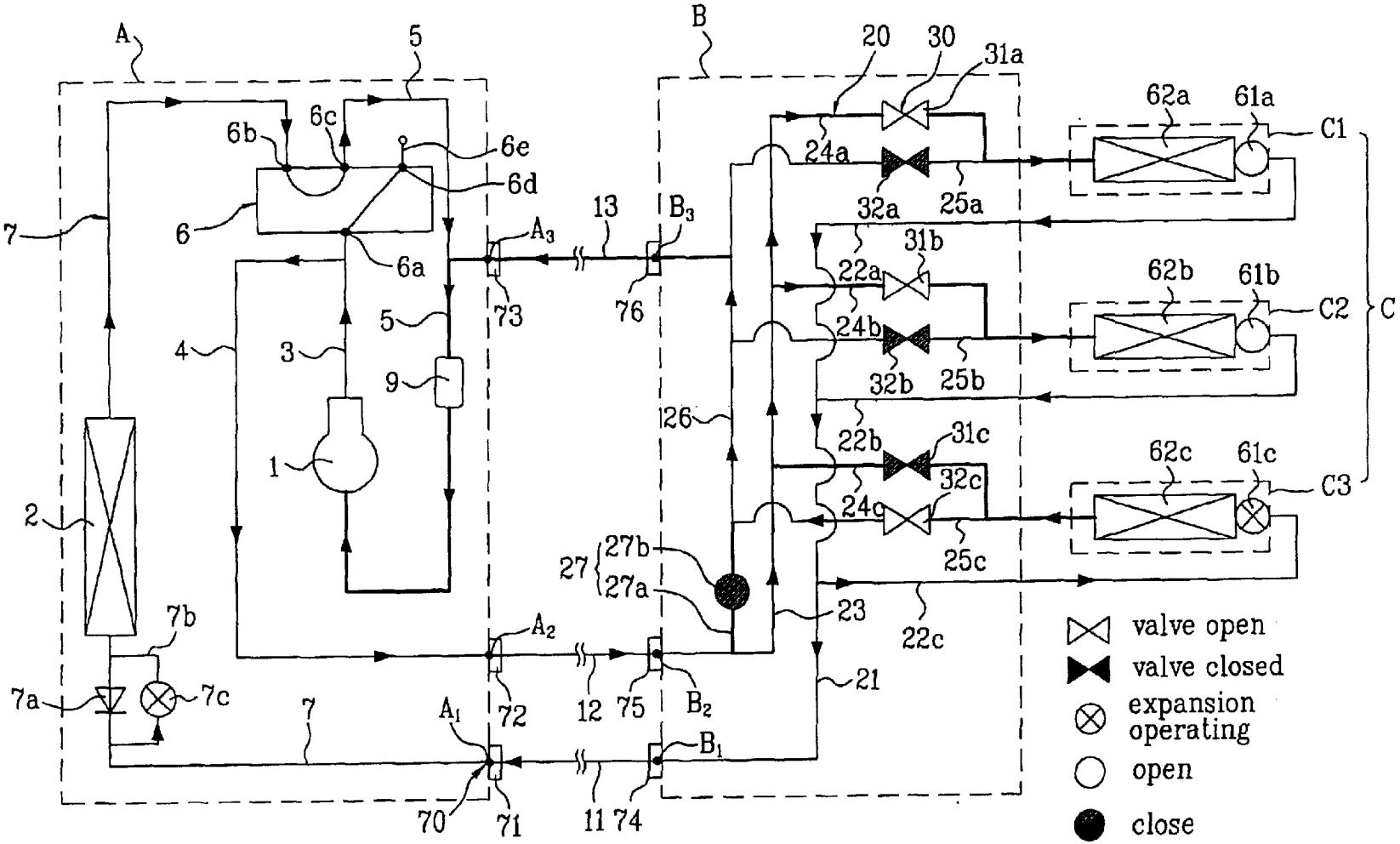
FIG. 3B illustrates a system showing operation of the system in FIG. 1 in heating a major number of rooms and cooing a minor number of rooms.

FIG. 3B illustrates a system showing operation of the system in FIG. 1 in the fourth operation mode. In the fourth operation mode, when a major number of rooms are heated and a minor number of rooms are cooled, the flow path control valve 6 makes the first port 6*a* and the fourth port 6*d* in communication and makes the second port 6*b* and the third port 6*d* in communication. Therefore, entire refrigerant is introduced from the compressor 1 to the distributor 'B' via the third pipeline 4. In this instance, the fifth strainer 75 prevents the foreign matters in the second connection pipeline 12 from entering into the distributor 'B'.

In the fourth operation mode, the distributor expansion device 27*b* is closed. The valves 31*a*, and 31*b* on the first gas refrigerant branch pipelines 24*a* and 24*b* connected to the indoor units C1 and C2 which heat the rooms are opened, and the valves 32*a* and 32*b* on the second gas refrigerant branch pipelines are closed. The valve 31*c* on the first gas refrigerant branch pipeline 24*c* connected to the indoor unit C3 which cools the room is closed, and the valve 32*c* on the second gas refrigerant branch pipeline 25*c* is opened. Therefore, the refrigerant introduced into the gas refrigerant pipeline 23 of the distributor 'B' via the second pipeline 7 is introduced into the indoor heat exchangers 62*a* and 62*b* via the first gas refrigerant branch pipelines 24*a* and 24*b*, and flows to the liquid refrigerant pipeline 21 via the liquid refrigerant branch pipelines 22*a* and 22*b* after heating the rooms at the indoor units C1 and C2.

Referring to FIG. 3B, a portion of the refrigerant introduced into the liquid refrigerant pipeline 21 is introduced into the liquid refrigerant branch pipelines 22*c* and the other portion of the refrigerant flows toward the first connection pipeline 11. In this instance, the refrigerant introduced into the first connection pipeline 11 is introduced into the fourth pipeline 5 via the second pipeline 7, the parallel pipe piece 7*b*, the outdoor unit expansion device 7*c*, the outdoor heat exchanger 2, and the flow control valve 6. The refrigerant introduced into the liquid refrigerant branch pipeline 22*c* passes through the indoor expansion valve 61 and the indoor heat exchanger 62*c* of the indoor unit C3, and cools the room, and, therefrom, introduced into the fourth pipeline 5 via the second gas refrigerant branch pipeline 25*c*, the return pipeline 26, and the third connection pipeline 13. During above process, the first strainer 71 prevents the foreign matters in the first connection pipeline 11 from entering into the outdoor unit 'A', and the third strainer 73 prevents the foreign matters in the third connection pipeline 13 from entering into the outdoor unit 'A'. Finally, the refrigerant joined at the fourth pipeline 5 is introduced into the inlet of the compressor 1 via the accumulator 9.

As has been described, the multi-type air conditioner of the present invention has the following advantages.

First, the independent cooling or heating of the plurality of rooms can provide an optimal air condition performance proper to an environment of each room.

The effective cutting off of the foreign matters in the long connection pipelines between the distributor and the outdoor unit from entering into the distributor or the outdoor unit by means of the foreign matter cutting off means permits to prevent malfunction or out of order of the air conditioner.

In the meantime, a multi-unit air conditioner has been described, in which one outdoor unit, one distributor, and a plurality of indoor units are provided for independent cooling or heating of rooms. It will be apparent to those skilled in the art that various modifications and variations can be made in the present invention without departing from the spirit or scope of the invention. For an example, the multi-type air conditioner having one outdoor unit and a plurality of indoor units is made to cool or heat a plurality of rooms at the same time, and when foreign matter cutting off means are provided between the outdoor unit and the indoor units, entrance of the foreign matters into the outdoor unit and the indoor units can be prevented, thereby permitting to prevent malfunction and out of order of the air conditioner, effectively. Thus, it is intended that the present invention cover the modifications and variations of this invention provided they come within the scope of the appended claims and their equivalents.

What is claimed is:

1. A multi-type air conditioner comprising:

an outdoor unit having a compressor, an outdoor heat exchanger, and an outdoor unit piping system;

a plurality of indoor units each having an expansion device, an indoor heat exchanger, and an indoor piping system;

connection pipelines connected between the outdoor unit and the indoor units; and a foreign matter cutoff device mounted on each of the connection pipelines for preventing foreign matter from entering into the compressor of the outdoor unit.

2. The multi-type air conditioner as claimed in claim 1, wherein the foreign matter cutoff device is mounted adjacent to ports of the outdoor unit connected to the connection pipelines.

3. The multi-type air conditioner as claimed in claim 1, further comprising a distributor located between ends of the connection pipelines, the distributor having ports to which the connection pipelines are connected, wherein the foreign matter cutoff device is mounted adjacent to a port of the distributor.

4. The multi-type air conditioner as claimed in claim 1, wherein the foreign matter cuttoff device comprises a strainer.

5. A multi-type air conditioner comprising:

an outdoor unit having a compressor, an outdoor heat exchanger, a flow path control valve for controlling a flow path of refrigerant from the compressor, and an outdoor unit piping system;

a plurality of indoor units each having an indoor unit expansion device, an indoor heat exchanger, and an indoor piping system;

a distributor for receiving refrigerant from the outdoor unit, distributing the refrigerant to the indoor units in accordance with respective operation modes, and returning refrigerant to the outdoor unit;

connection pipelines connected between the outdoor unit and the distributor; and a foreign matter cutoff device mounted on each of the connection pipelines for preventing foreign matter from entering into the compressor of the outdoor unit.

6. The multi-type air conditioner as claimed in claim 5, wherein the foreign matter cutoff device is mounted adjacent to ports of the outdoor unit connected to the connection pipelines.

7. The multi-type air conditioner as claimed in claim 6, wherein the foreign matter cutoff device is further mounted adjacent to a port of the indoor units having the connection pipelines connected thereto.

8. The multi-type air conditioner as claimed in claim 5, wherein the foreign matter cutoff device comprises a strainer.

9. The multi-type air conditioner as claimed in claim 5, wherein the multi-type air conditioner is connected to a plurality of areas and wherein the operation modes include:

a first operation mode for cooling all areas, a second operation mode for heating all areas, a third operation mode for cooling a majority of areas and heating a minority of areas, and a fourth operation mode for heating a majority of areas and cooling a minority of areas.

10. The multi-type air conditioner as claimed in claim 5, wherein the flow path control valve includes:

a first port in communication with an outlet of the compressor, a second port in communication with the outdoor heat exchanger, a third port in communication with an inlet of the compressor, and a fourth port blanked or connected to a blanked pipe piece.

11. The multi-type air conditioner as claimed in claim 10, wherein the outdoor unit piping system includes:

a first pipeline connected between the outlet of the compressor and the first port of the flow path control valve, a second pipeline connected between the second port of the flow path control valve and a first port of the outdoor unit having the outdoor heat exchanger mounted thereon, a third pipeline connected between the first pipeline and the second pipeline of the outdoor unit, and a fourth pipeline connected between the third port of the flow path control valve and the inlet of the compressor having an intermediate point connected to a third port of the outdoor unit.

12. The multi-type air conditioner as claimed in claim 11, wherein the outdoor unit further includes an accumulator mounted on the fourth pipeline between the third port of the outdoor unit and the inlet of the compressor.

13. The multi-type air conditioner as claimed in claim 11, wherein the outdoor unit further includes:

a check valve mounted on the second pipeline between the outdoor heat exchanger and the first port of the outdoor unit, and an outdoor unit electronic expansion device mounted on the second pipeline in parallel with the check valve.

14. The multi-type air conditioner as claimed in claim 13, wherein the check valve only permits refrigerant flow from the outdoor heat exchanger toward the first port of the outdoor unit.

15. The multi-type air conditioner as claimed in claim 11, wherein the connection pipelines include:

a first connection pipeline connected between the first port of the outdoor unit and a first port of the distributor, a second connection pipeline connected between the second port of the outdoor unit and a second port of the distributor, and a third connection pipeline connected between the third port of the outdoor unit and a third port of the distributor.

16. The multi-type air conditioner as claimed in claim 15, wherein the distributor includes:

a distributor piping system for guiding refrigerant flow from the outdoor unit to the indoor units, and from the indoor units to the outdoor unit, and a valve bank mounted on the distributor piping system for controlling the refrigerant flow in the distributor piping system in accordance with the respective operation modes.

17. The multi-type air conditioner as claimed in claim 16, wherein the distributor piping system includes:

a liquid refrigerant pipeline connected to a first port of the distributor, a plurality of liquid refrigerant branch pipelines branched from the liquid refrigerant pipeline and connected to the indoor unit expansion devices in the indoor units respectively, a gas refrigerant pipeline connected to a second port of the distributor, a plurality of first gas refrigerant branch pipelines branched from the gas refrigerant pipeline and connected to the indoor heat exchangers of the indoor units respectively, a plurality of second gas refrigerant branch pipelines branched from intermediate points of the first gas refrigerant branch pipelines respectively, a return pipeline connected to all the second gas refrigerant pipelines, and connected to a third port of the distributor.

18. The multi-type air conditioner as claimed in claim 17, wherein the valve bank includes a plurality of open/close valves mounted on the first and second gas refrigerant branch pipelines.

19. The multi-type air conditioner as claimed in claim 18, wherein the distributor further includes a liquefaction preventer which prevents liquefied refrigerant discharged from the compressor from filling the third pipeline.

20. The multi-type air conditioner as claimed in claim 19, wherein the liquefaction preventer includes:

a bypass pipeline connected between the return pipeline and the gas refrigerant pipeline, and a distributor expansion device on the bypass pipeline.

* * * * *